US005890919A

United States Patent [19]

Geisler

[11] Patent Number: 5,890,919

[45] Date of Patent: Apr. 6, 1999

[54] LOCK-OUT DEVICE FOR ELECTRICAL PLUGS

[76] Inventor: James H. Geisler, 1406 E. Pine St., Midland, Mich. 48640

[21] Appl. No.: 855,015

[22] Filed: May 13, 1997

[51] Int. Cl.[6] ..... H01R 13/44

[52] U.S. Cl. ..... 439/134

[58] Field of Search ..... 439/133, 134, 439/369, 370, 371; 383/72, 74, 92; 24/30.5 P, 30.5 R

[56] References Cited

U.S. PATENT DOCUMENTS

| | | | |
|---|---|---|---|
| 656,398 | 8/1900 | Fairfax | 383/71 |
| 1,055,002 | 3/1913 | Yarnum | 24/30.5 R |
| 1,062,506 | 5/1913 | Rickard . | |
| 1,753,254 | 4/1930 | Thaxton | 24/30.5 R |
| 4,648,667 | 3/1987 | Baumgart . | |
| 4,673,230 | 6/1987 | Baumgart . | |
| 4,785,960 | 11/1988 | Belisle | 383/74 |
| 5,178,551 | 1/1993 | Bach | 439/133 |
| 5,186,636 | 2/1993 | Boyer et al. | 439/134 |

*Primary Examiner*—Neil Abrams
*Assistant Examiner*—Brian J. Biggi
*Attorney, Agent, or Firm*—Robert L. McKellar

[57] ABSTRACT

A lock-out device for electrical cables and associated plugs that is intended to allow the workman to protect against the possibility of a re-connection of any plug in the device, while the workman is working on the electrical apparatus associated with such plug. The lock-out device is comprised essentially of a flexible containment chamber, a keeper bar, a perforated strap, a fastener for the strap, a locking device for the keeper bar, and a pocket, which has two openings.

14 Claims, 1 Drawing Sheet

LOCK-OUT DEVICE FOR ELECTRICAL PLUGS

The invention disclosed and claimed herein deals with a lock-out device for electrical plugs that is intended to allow the workman to protect against the possibility of a re-connection of any plug in the device, while the workman is working on the electrical apparatus associated with such plug.

The lock out device of this invention is intended to allow easy access to the plugs for the workman and is a temporary keeping device and is not necessarily intended to prevent unauthorized intrusion by others.

BACKGROUND OF THE INVENTION

This invention deals with a means of providing security against the unwanted, or unintended use of electrical plugs. For safety reasons, it is often desirable to prohibit the use of certain electrically operated devices, for example, when an electrician is working on an electrical system, it is imperative that some other person does not activate the system electrically and therefore, if the workman can temporarily interrupt the electricity, and can be assured that no other person can accidentally re-activate the electricity, then the workman can work with the system without danger of being electrocuted. The instant invention is intended to provide a simple, inexpensive, efficient means of securing such electrical plugs.

One such device for this purpose is disclosed in U.S. Pat. No. 4,648,667, which issued Mar. 10, 1987 to Baumgart, in which there is shown an apparatus having a containment chamber associated with a locking means. Spaced pairs of apertures are located at the top portion on opposite sides of the chamber. An electrical plug and its associated cable are inserted into the chamber with the shackle of the locking means being inserted through the apertures so as to encircle the electrical cable when in the locked position to capture the electrical plug within the chamber. Thus, this device depends on the locking means per se to prevent the removal of the electrical plug and does not depend on the containment chamber for such a purpose.

A second United States Patent to Baumgart, U.S. Pat. No. 4,673,230, which issued Jun. 16, 1987, discloses a similar device for preventing the unauthorized use of electrical plugs. The apparatus has a chamber which has a bottom and a peripherally extending side wall with an open top portion. There is an aperture in the bottom of the receiving cable. The device slides up and down on the cable, and when in use, the device is moved to the end of the cable, thereby enclosing the plug end, and a locking means is used at the top to prevent the removal of the electrical plug. In other words, this device is permanently associated with the electrical plug, and cannot be used on any other electrical plug for protection.

Finally, the inventor herein is aware of U.S. Pat. No. 1,062,506 to Rickard, which issued on May 20, 1913, which deals with a mail pouch and lock to secure mail. The locking device is comprised of a locking means, and a strap, which is designed to work with the locking device, whereupon, the strap of the assembly is pulled around the top of the mail bag to close the top of the mail bag, and then the strap is inserted into its locking means and locked therein.

Although this device appears to be very close in operation to the device of the instant invention, it can be noted that it differs, in that, the strap and lock are a unitary assembly and if the lock fails, the entire assembly fails, and therefore, a whole new assembly has to be used, whereas in the instant invention, if the lock fails, it is only the lock that has to be replaced. Further, the assembly is dependent on openings in the mail bag itself for the locking device to be positioned correctly for locking.

The apparatus of Rickard is large and cumbersome. Further, it is used on mail bags, and there is no disclosure in that patent that would indicate that device could be used in a method of securing electrical cables. Even if that disclosure were present in the Rickard reference, the Rickard device does not have the versatility of the device of the instant invention, in that, in order to draw the bag tight to lock, the Rickard device would only leave enough opening for one or two cords through the top opening owing to the strap and lock means being one assembly and the strap means having only one point at which the lock means is activated, while the device of the instant invention is good for multiple plug use.

None of the devices of the prior art provide the simplicity, efficiency, and low cost benefits of the device of the instant invention.

THE INVENTION

The invention herein deals with a lock-out device for securing electrical plugs for unwanted use.

Thus, the invention is a lock-out device for electrical plugs, which device comprises in combination, (A) a flexible containment chamber having a closed bottom, an open top, and a top edge. The, flexible containment chamber also has a pocket located adjacent and essentially entirely around the top edge of the containment chamber wherein the pocket has two adjacent openings.

Component (B) is a flexible, multi-perforated strap inserted slidably through one of the openings in the pocket, through the pocket, and out the other opening of the pocket. The multi-perforations have center points and the strap extends beyond the openings in the pocket to form two extended straps. The extended straps have ends distal to (A) and the extended straps are fixed to each other at the distal ends.

Component (C) is a keeper bar, the keeper bar has a centered aperture in it, and the keeper bar is slidably mounted on both of the extended ends of the flexible multi-perforated strap, and through the centered aperture. The perforations in the multi-perforated strap are essentially equally spaced from each other, and aligned essentially through their center points to form pairs.

Also, an additional embodiment of the invention is a method of securing at least one electrical plug, the method comprising inserting at least one electrical plug into a device as set forth above, and thereafter, pressing the keeper bar against the flexible containment chamber until the top opening is closed tightly around any cable to be secured, and thereafter, equipping the device with the locking device to secure the keeper bar against the flexible containment chamber such that none of the electrical plugs can be removed.

DETAILED DESCRIPTION OF THE INVENTION

This invention therefore deals with a lock-out device for electrical plugs that is intended to allow the workman to protect against the possibility of a re-connection of any plug in the device, while the workman is working on the electrical apparatus associated with such plug.

Figure 4:
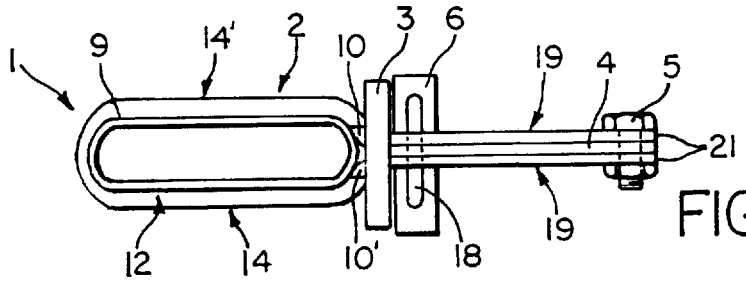
FIG. 4 is a full top view of the device of FIG. 1.
Figure 2:
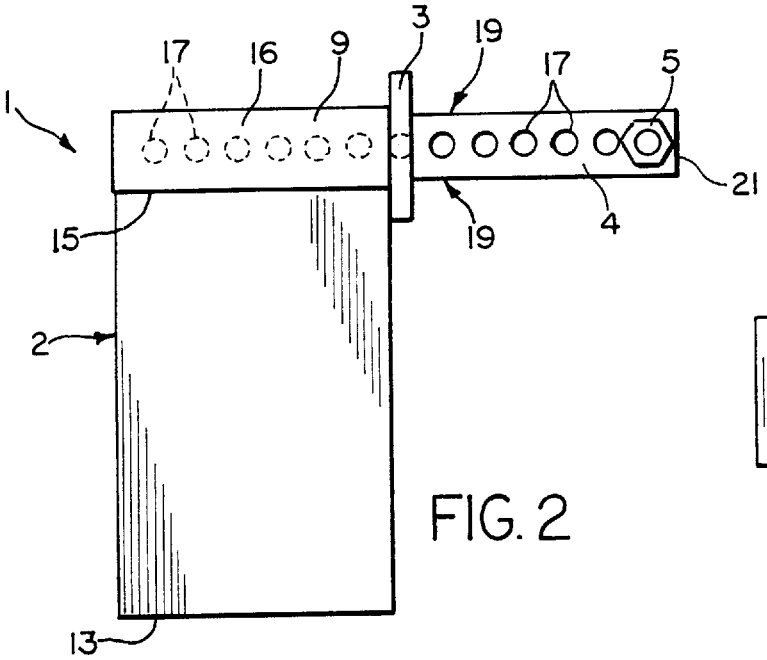
FIG. 2 is a full side view of the device of FIG. 1, in the open position, and without the electrical plug and locking means.
Figure 1:
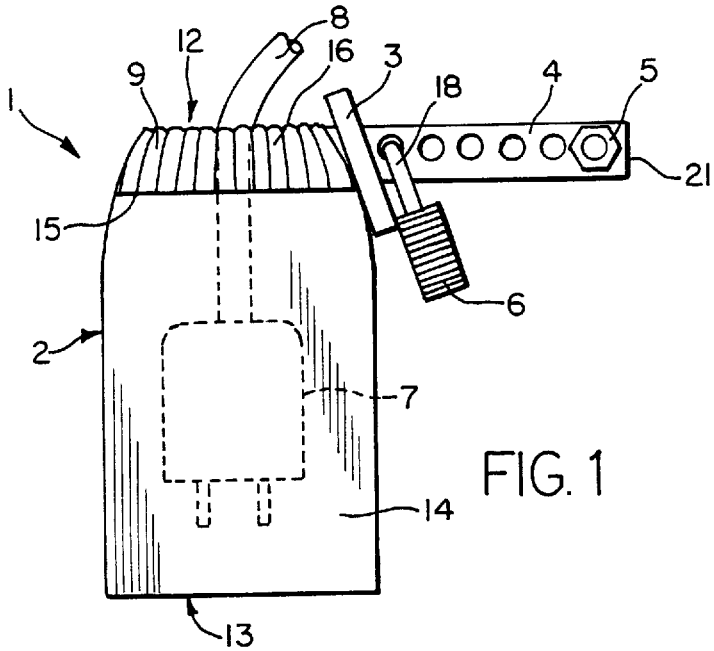
FIG. 1 is a full side view of one device of this invention, fully equipped, and in the closed position with an electrical plug and associated cable shown partially in phantom.

With reference to FIG. 1, 2, and 4, there is shown a device 1 of this invention wherein there is shown a flexible containment chamber 2, a keeper bar 3, a perforated strap 4, a fastener for the strap 5, a locking device 6 for the keeper bar 3, and an electrical plug 7 inserted into the chamber 2, wherein the plug is shown in phantom inside the chamber 2, with the electrical cable 8 for the plug 7 extending out of the chamber 2.

There is a pocket 9, which has two openings 10 and 10' (FIG. 4).

The flexible containment chamber 2 is designed to be flexible such that there is a minimal restriction on where the device 1 can be used, and further, by being flexible, it can accommodate a number of plugs but retain the ability for the top 12 to close to provide security for all of the plugs 7 that are required to be secured.

It should be noted that the device 1 of this invention is intended to "secure" the plugs 7, but it should be noted by those skilled in the art that the invention is a "keeping" device rather than providing full, non-intrusive security such as is provided by a safe or the like. In other words, someone with the intent of invading the flexible bag could do so easily with a knife or some other sharp instrument, and thus, "secure" as used herein means that the device is a "keeping" device that prevents occasional entry for safety reasons.

Thus, the flexible containment chamber 2 takes the form of a bag, which can be fabricated from inexpensive materials such as fabric, fiber reinforced fabric, thickened fabric, which may be several plies of fabric sewn together, leather, plastics, such as polyethylene and polypropylene, including cross-linked polyethylene, light metals such as aluminum, and the like, nylon reinforced fabric, canvas, and chain mail.

As indicated supra, the flexible containment chamber 2 has an upper end 12, which contains a pocket 9. The flexible containment chamber 2 has a bottom 13, and at least two side walls 14 and 14', and the pocket 9 is formed by turning the top edge 15 of the upper end 12 down over the side walls 14 and 14', to form a flap 16, and then fastening the turned down flap 16 at the top edge 15, to form the pocket 9, it being understood that the top edge 15 forms the outside bottom edge of the pocket 9. The pocket 9 has two openings 10 and 10', which allow the insertion of the strap 4. These openings are best illustrated in FIG. 4. Thus, one end of the strap 4 is inserted, for example, in opening 10, passed through the pocket 9, and withdrawn through opening 10', such that the strap 9 essentially encircles the top of the flexible containment chamber 2.

The ends of the strap 4 are intended, and do extend beyond the openings 10 and 10', to form extended strap portions 19. The strap 4 has multiple perforations 17, which are preferred to be essentially, equally spaced apart, in which the perforations 17 are essentially aligned in pairs by aligning the extended strap portions 19 of the strap 4, the purpose for the alignment being such that the hasp 18 of the locking device 6 can be inserted through the paired perforations 17 to lock the containment chamber 2. The locking device 6 is shown as a padlock, but it is contemplated within the scope of this invention to use any locking device that will provide at least a minimum of security, for example, it is contemplated within the scope of this invention to use a locking device 6 which is a spring metal pin, and the like.

Figure 3:
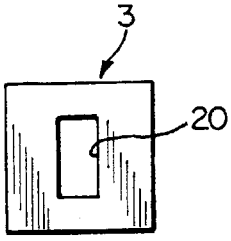
FIG. 3 is a full front view of a keeper bar of this invention.

In order to fully "keep" the flexible chamber 2 closed closely around the electrical cable 8, there is provided a keeper bar 3, shown in FIG. 3, which has a centered opening 20, shown in FIG. 3, which is mounted slidably on both of the extended strap portions 19, which keeper not only secures both of the extended strap portions 19, but also keeps the flexible chamber 2 closed at the top by sliding the keeper bar 3 up against the flexible chamber 2 in a tight configuration, and then inserting the locking device hasp 18 through the pair of perforations 17 which are nearest the back of the keeper bar 3, to maintain the keeper bar 3 in a close proximity to the flexible chamber 2, and thus to keep any cable 8, with plug 7 secured in the containment chamber 2.

The extended strap portions 19 are secured by some means 5 at their ends 21, distal to the flexible containment chamber 2, wherein the securing means 5 can be any means by which the two distal ends 21 are held securely together. For example, such a means 5 in FIGS. 1, 2, and 4 is shown by a simple nut and bolt arrangement, but this means 5 could be simply a welding, or gluing together of the ends. Preferred for this invention are nuts and bolts, rivets, welding, gluing, heat or chemical fusing, and the like.

FIG. 2 is a full side view of the device 1 of this invention showing the device 1 in an open position. The paired perforations 17 are also shown in phantom inside the pocket 9. Also shown is the keeper bar 3, the fastening means 5, and the extended strap portions 19 of the strap 4.

Turning now to the method of securing the electrical cable 8 and electrical plug 7, the method comprises inserting at least one electrical cable 8, with attached plug 7 into the flexible containment chamber 2, thereafter pressing the keeper bar 3 against the chamber 2 until the top opening 12 is closed, and thereafter, equipping the device 1 with a locking device 6 to secure the keeper bar 3 against the flexible containment chamber 2 such that none of the electrical cables 8 with attached electrical plugs 7 can be removed.

When desired, the operation can be reversed to remove the electrical cable 8 and associated plug 7, by removing the locking device 6, sliding the containment chamber top 12 outwardly along the extended strap portions 19, while at the same time moving the keeper bar 3 in the same direction, and then removing the cable 8 and the associated plug 7 from the containment chamber 2.

What is claimed is:

1. A lockout device for electrical plugs, said device comprising in combination, (A) a flexible containment chamber having a closed bottom, an open top, and a top edge, said flexible containment chamber having a pocket located adjacent and essentially entirely around the top edge thereof, said pocket having two adjacent openings therein;

(B) a flexible, multi-perforated strap inserted slidably through one opening in the pocket, through the pocket, and out the other opening of the pocket, said multi-perforations having center points and said strap extending outside of the openings in the pocket to form two extended strap portions thereof, said extended strap portions having ends distal to the openings in (A), said extended strap portions being fixed to each other at said distal ends;

(C) a keeper bar, said keeper bar having a centered aperture therein, said keeper bar being slidably mounted on both of the extended strap portions of the flexible multi-perforated strap, through the centered aperture thereof, the perforations in the multi-perforated strap being essentially equally spaced from each other, and aligned essentially through their center points, in pairs.

2. The device as claimed in claim 1 wherein the flexible containment chamber is made of flexible leather.

3. The device as claimed in claim 1 wherein the flexible containment chamber is made of chain mail.

4. The device as claimed in claim 1 wherein the flexible containment chamber is made of plastic.

5. The device as claimed in claim 1 wherein the flexible containment chamber is made of a light metal.

6. The device as claimed in claim 5 wherein the light metal is aluminum.

7. The device as claimed in claim 1 wherein the flexible containment chamber is made of fiber reinforced fabric.

8. The device as claimed in claim 1 wherein the flexible containment chamber is made of thick fabric.

9. The device as claimed in claim 1 wherein the flexible containment chamber is made of nylon fabric.

10. The device as claimed in claim 1 wherein the flexible containment chamber is made of canvas.

11. The device as claimed in claim 1, wherein there is further used in combination, a locking device which inserts through any pair of perforations to allow secure containment of one or more electrical cables with associated electrical plugs.

12. The device as claimed in claim 11, wherein the locking device is a padlock.

13. The device as claimed in claim 11, wherein the locking device is a metal clip.

14. A method of securing at least one electrical plug, the method comprising inserting at least one electrical cable with associated electrical plug into a device of claim 11, and thereafter, pressing the keeper bar against the flexible containment chamber until the top opening is closed, and thereafter, equipping the device with the locking device to secure the keeper bar against the flexible containment chamber such that none of the electrical plugs can be removed.

* * * * *